United States Patent [19]

Dietrich et al.

[11] Patent Number: 4,490,701

[45] Date of Patent: Dec. 25, 1984

[54] ELECTROMAGNETIC SWITCHGEAR COMPRISING A MAGNETIC DRIVE AND A CONTACT APPARATUS PLACED THEREABOVE

[75] Inventors: Bernhard Dietrich, Eichenau, Fed. Rep. of Germany; Hidetoshi Matsushita, Ibaraki; Tetsuo Mori, Hirakata, both of Japan

[73] Assignees: SDS-Elektro GmbH; Matsushita Electric Works, Ltd., both of Japan

[21] Appl. No.: 523,534

[22] Filed: Aug. 16, 1983

[30] Foreign Application Priority Data

Aug. 17, 1982 [DE] Fed. Rep. of Germany ..... 3230564

[51] Int. Cl.[3] ..... H01H 51/22; H01H 45/00

[52] U.S. Cl. ..... 335/78; 335/131; 335/136

[58] Field of Search ..... 335/78, 79, 81, 84, 335/85, 131, 132, 136, 256

[56] References Cited

U.S. PATENT DOCUMENTS 2,794,882 6/1957 Russell ..... 335/131

3,800,251 3/1974 Usui et al. ..... 335/131

*Primary Examiner*—E. A. Goldberg

*Assistant Examiner*—George Andrews

*Attorney, Agent, or Firm*—Jones, Tullar, Cooper

[57] ABSTRACT

Switchgear consisting of a polarized magnetic drive and a contact apparatus placed thereabove is disclosed. The contact apparatus includes an adjusting slider which is movable to actuate bridge contacts and is operably connected to return springs which urge it to a neutral position. To obtain two or three stable positions of the adjusting slide without constructional modifications of the switchgear, the coil form for the magnetic drive is divided into two chambers which are spaced apart, are arranged side by side, and accommodate two coil windings. Between the coil forms and symmetrical to the longitudinal axis of the coil form is connected to a permanent magnet arrangement which is polarized at right angles to the longitudinal axis of the coil form and has a central through-port for a central armature. The armature is mounted with allowance for moving longitudinally in the bore of the coil form and is connected by means of a lever to the adjustable slider, so that the armature is urged to a stable central, or neutral, position by means of the two preloaded return springs. The springs are so arranged that when the armature slides from its central position in one or the other direction, only one or the other of the openings is activated.

12 Claims, 13 Drawing Figures

ELECTROMAGNETIC SWITCHGEAR COMPRISING A MAGNETIC DRIVE AND A CONTACT APPARATUS PLACED THEREABOVE

BACKGROUND OF THE INVENTION

The present invention relates, in general, to an electromagnetic switchgear drive, and more particularly to a magnetic drive mechanism incorporating a yoke which encloses a permanent magnetic arrangement and which surrounds a coil form. The coil form has a continuous bore which contains a movable armature that is connected by means of a reverse-transfer lever to actuate a movable slider mounted with allowance for sliding in a contact apparatus. The slider is located above the coil form, parallel to the longitudinal axis thereof, and is in operative contact with two return springs preloaded in opposite directions, which urge the slider to a neutral, or central, position. The slider carries spring-loaded bridge contacts to each of which are assigned two opposed fixed contacts of the switchgear.

The type of switchgear to which the present invention relates is described in applicants' German patent application No. P 31 38 265.7 which is acknowledged as disclosing the state-of-the-art, but which has not been published as prior art. The armature in that prior device is mounted with allowance for tilting in the vicinity of one of two coil form flanges, and extends with both ends beyond the flanges. The armature cooperates with pole faces on the yoke and with a permanent magnet arrangement in which two rod-shaped permanent magnets lie above the coil form and are parallel thereto.

In applicants' prior patent application, a leaf spring is provided which engages a reverse-transfer lever, with the opposite end of the spring leaf bearing against the housing of the contact apparatus. In the case of a mono- or bistable design of the switchgear, the spring is made of one piece, but in the case of a tristable design; i.e., with a central position of the adjustable slide in which all contacts are open, the spring consists of two spring leaves which are pre-loaded in opposite directions. Whereas the mono- and bistable operations of that switchgear offers no special features; i.e., the direction of motion of the armature and, thereby, of the adjusting slide is determined, as in the case of any polarized magnetic drive, by the direction of current flow through the coil, tristable operation presents a difficulty. To obtain tristable operation, a drop-out pulse with an accurately predetermined current level and duration is needed for reaching the central position in order, on the one hand, to achieve a secure drop-out and, on the other hand, to prevent overshooting of the central position. In that prior device, it is also of importance that the desired course of the return spring force be obtained as a function of the armature path by means of the split spring leaf described above.

SUMMARY OF THE INVENTION

The object of the present invention is to provide switchgear of the type described above which is capable of both bistable and tristable operation without modifications, and which does not make severe demands upon the level and duration of the required switching pulses in order to achieve the desired operating positions.

In accordance with the teachings of the present invention, the foregoing object is achieved in switchgear of the type described by providing a magnetic drive mechanism having a yoke enclosing a permanent magnet arrangement and surrounding a coil form. The coil form is divided into two spaced-apart chambers which are arranged side-by-side to accommodate two coil windings. The permanent magnet arrangement is positioned symmetrically to the longitudinal axis of the coil form and is located between the two chambers thereof. The magnet is polarized at right angles to the longitudinal axis of the coil form (i.e., radially), and is provided with a through-port having a diameter which corresponds substantially to the diameter of the bore of the coil form and which is adapted to receive the armature. The armature is attached to a non-magnetic guide bar and has two longitudinally spaced end faces which cooperate with the pole faces of the yoke. These pole faces are located in the area of the corresponding end openings of the bore in the coil form. The armature is connected to the slider and is urged toward its geometrical central position by two opposed return springs which engage the adjusting slider, the slider tensioning or compressing only one of the return springs upon leaving its central position.

As described in the periodical ETZ-A, Volume 86 (1965), No. 11, pp. 371–375, a polarized top-magnet system is known which contains a coil form divided into two spaced-apart chambers which are arranged side-by-side and between which there is placed a ring-shaped permanent magnet with radial magnetization and a through-port for the armature, the armature having two end faces which cooperate with the end faces of the pot-shaped yoke, the device serving to actuate a bridge contact. However, this top-magnet system has only a single coil the windings of which are distributed between the two chambers and, therefore, can only be used for bistable and, under certain conditions, monostable operation.

By contrast, as a result of the separate coil windings combined with the special design of the two return springs, the switchgear of the present invention permits bistable or tristable operation without constructional modifications. Bistable performance is possible in coil windings through which current flows equidirectionally in one or the other direction. In such a case, the geometrical central position of the adjusting slide, in which all contacts are open, is subject to overshooting, but stable performance results as a current is caused to flow in opposite directions in both coil windings. Each coil winding generates only half of the total excitation and since they are in opposite directions, that is sufficient to jetison the armature with certainty from either end position against the holding force of the permanent magnet and with the assistance of the spring that is activated when the armature is in the end position. Thereafter, the combined action of the two return springs will hold the armature securely in its central position, since both the electromagnetic and the permanent magnet forces cancel each other out.

According to a preferred embodiment of the invention, which can be constructed very quickly, the yoke incorporates two core pieces which extend axially within the coil form. The core pieces include pole faces turned toward the central armature and in the area of the pole faces the core pieces are constructed as bearing points for receiving the armature guide bar and supporting it for axial motion within the bore of the coil form. This design makes possible the very small air gaps between the permanent magnet arrangement and the armature, since any bending of the armature guide bar due to the magnetic forces acting radially on the armature remains small, due to the location of the bearing point close to the corresponding ends of the armature. No force is applied to the armature guide bar if the armature is positioned exactly in the center of the through-port, or bore in the permanent magnet, because the radially engaging permanent magnet forces cancel each other out. However, in practice, one can expect eccentricities between the armature and the bore in the permanent magnet, which can cause considerable bending forces to be applied to the guide bar of the armature.

In the simplest case, the permanent magnet arrangement can consist of a single disk-shaped permanent magnet. However, for reasons of production engineering, an embodiment is preferred wherein the permanent magnet arrangement consists of two opposed rectangular parallelepipedal permanent magnets, wherein the poles of the permanent magnets which face each other have the same polarity. In this embodiment, the armature is cylindrical, but is flattened in the area of the poles of the permanent magnets.

For similar reasons of production engineering, the yoke can be composed of two yoke halves each having a flat profile.

Expensive mounting devices, such as are frequently needed for the assembly of the devices containing preloaded springs, can be dispensed with in the case of an embodiment of the invention wherein the return springs consist of two preloaded helical compression springs lying coaxially opposed in a recess of the housing of the contact apparatus. Between the facing ends of the springs is placed a driving lug which is a part of the adjusting slide and which, during movement of the slide from its central position, compresses only one of the return springs, while the other return spring abuts against housing projections at the central location.

The armature path and the force supplied by the armature, as well as the force required for its actuation, can be simply adjusted to the path of the adjusting slide by hinging a reverse-transfer lever to the end of the armature guide bar and mounting the lever on a pivot in a fulcrum in the manner of a two-arm lever.

BRIEF DESCRIPTION OF THE DRAWINGS

The various objects, features and advantages of the switchgear of the present invention will be more fully understood from the following detailed description thereof taken in conjunction with the accompanying drawings which include a simplified diagram illustrating the operation of a specific embodiment thereof. In the drawing.

DESCRIPTION OF PREFERRED EMBODIMENTS

Figure 1A:
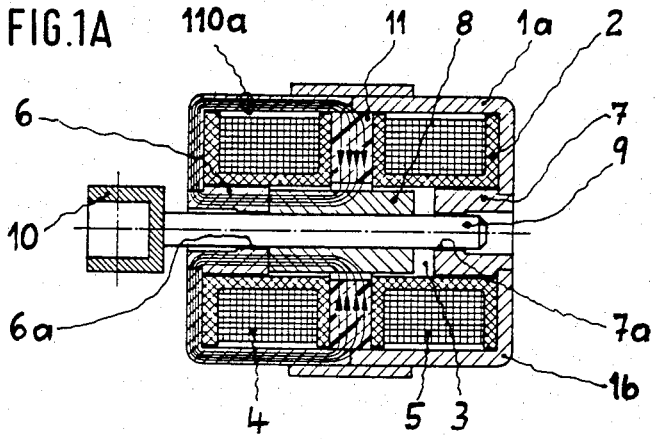
FIGS. 1*a* and 1*b* are cross-sectional views taken along the line a—a of FIG. 2, illustrating the magnetic drive of the switchgear in the two end positions of the armature.
Figure 1B:
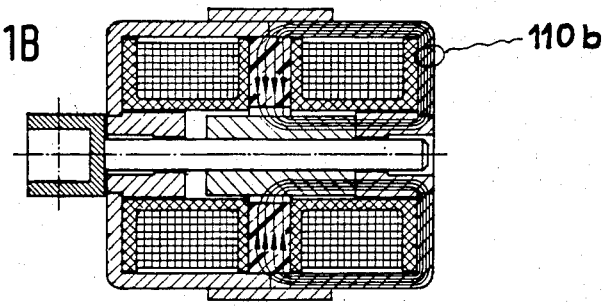

As shown in FIGS. 1*a* and 1*b*, the magnetic drive of the switchgear of the present invention consists of two yoke halves 1*a* and 1*b* each of which, for reasons of production engineering, is composed of three parts, a left-hand portion, a right-hand portion, and a central bridging portion, as viewed in FIG. 1*a*. The two yoke halves enclose a coil form 2 which is divided into two annular chambers which surround a continuous bore 3, each chamber containing its own coil, or winding, 4 and 5, respectively. The yoke halves 1*a* and 1*b* each extend into the bore 3 of the coil form from the two opposite ends thereof by means of core pieces 6 and 7, respectively. The inner ends of the core pieces constitute pole faces which cooperate with respective end faces of an armature 8 constructed of soft magnetic material. The armature 8 is secured to a guide bar 9 which is mounted with allowance for axial sliding motion in bearing bores 6*a* or 7*a* of the core pieces 6 and 7, respectively. These bearing bores 6*a* and 7*a* are provided as far inward as possible, so that they lie very close to the pole faces of the core pieces 6 and 7. The guide bar 9 extends with its left-hand end, as viewed in FIGS. 1*a* and 1*b* extending beyond the left-hand end faces of the yokes 1*a* and 1*b*, and terminates in a fork 10.

There is located between the two chambers of the coil form a radially polarized permanent magnet 11. When the armature 8 is in the left end position illustrated in FIG. 1*a*, the magnetic flux path of magnet 11 is closed through the armature 8, the core piece 6, and the left-hand ends of the yoke 1*a* and 1*b*, as indicated by the flux lines 110*a* in FIG. 1*a*. When the armature 8 is in the right end position illustrated in FIG. 1*b*, the flux path for magnet 11 is closed through the armature 8, the core piece 7 and the right-hand ends of the yoke halves 1*a* and 1*b*, as illustrated by the flux lines 110*b* in FIG. 1*b*. The closed flux paths so provided enable the permanent magnet to hold the armature in either its left end or right end positions.

Figure 2:
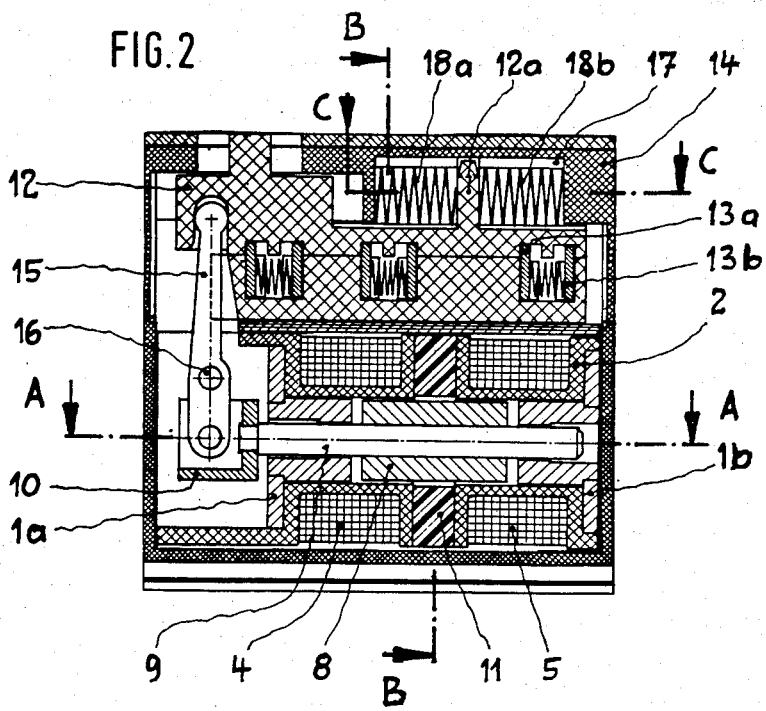
FIG. 2 is a cross-sectional side view of the complete switchgear.
Figure 5:
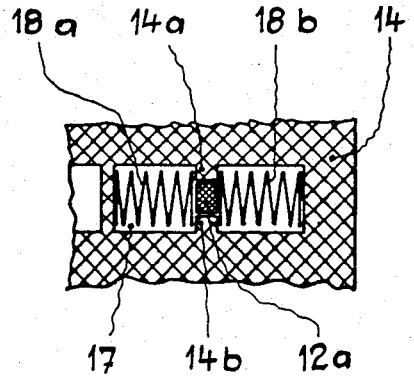
FIG. 5 is a partial cross-sectional view taken along the line c—c in FIG. 2.

As apparent from FIG. 2, the contact apparatus of the switchgear is placed above the magnetic drive mechanism illustrated in FIGS. 1*a* and 1*b*. The contact apparatus comprises an adjusting slide 12 mounted with allowance for sliding in a housing 14. The slide carries three contact bridges, each of which is composed of two single bridges 13*a* and 13*b* which are spring loaded against each other. The adjusting slide 12 is connected with the fork 10 of the armature guide bar 9 by way of a two-arm reverse-transfer lever 15 which is mounted to pivot about a fulcrum 16. The central position of armature 8, which is shown in FIG. 2, is insured by two preloaded axially aligned helical compression springs 18*a* and 18*b* secured in a recess 17 of the housing 14. The facing inner ends of the springs 18*a* and 18*b* bear against opposite sides of a lug 12*a* of the adjusting slide 12, which lug extends into the recess 17. As apparent from FIG. 5, the housing 14 has two projections 14*a* and 14*b* which extend into the recess 17 to engage the inner facing ends of springs 18*a* and 18*b*. These projections 14*a* and 14*b* are spatially arranged in alignment with the lug 12*a* when the adjusting slide is in its central position, and prevent the compression spring from extending beyond that central position. The result is that during the movement of the adjusting slide 12 from its central position, one spring only, either 18*a* or 18*b*, will be activated to serve as a return spring, while the other spring abuts the projections 14*a* and 14*b* so that its action is neutralized. When the adjusting slide 12 is released, it is certain to return to its geometrical central position whereboth helical springs will act on it equally. In this central position, both the permanent magnet forces and any electromagnetic forces which caused the armature to drop-out to the central position will compensate each other.

Figure 3:
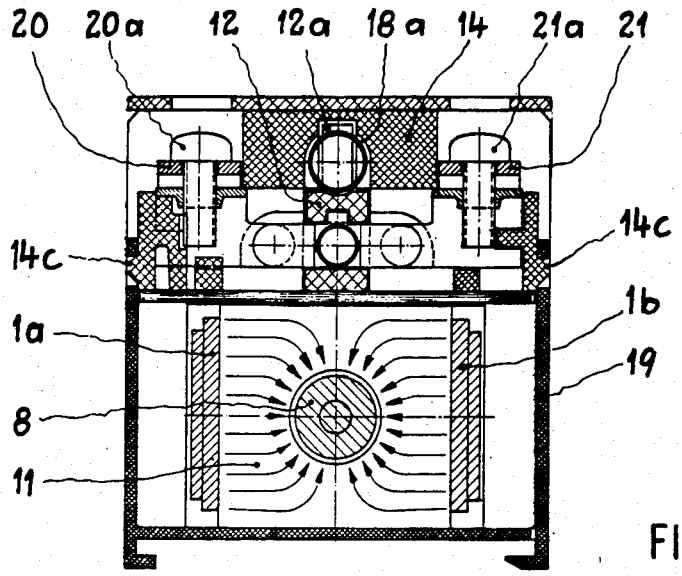
FIG. 3 is a cross-sectional view taken along the line b—b in FIG. 2.
Figure 4:
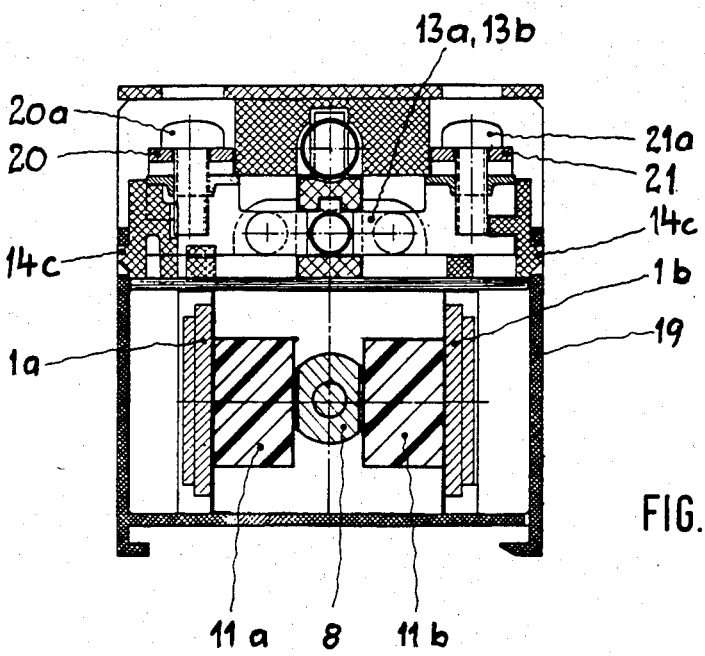
FIG. 4 is a cross-sectional view according to FIG. 3, but with a modified permanent magnet arrangement.

An alternative to the radially magnetized permanent magnet 11 of FIG. 3 is illustrated in FIG. 4, wherein two permanent magnets 11*a* and 11*b* are provided. Two magnets are more advantageous from the production engineering standpoint, and as illustrated they are placed opposite to each other and polarized in such a way that two like poles lie opposite to each other in relation to the armature 8. To obtain sufficiently large pole faces, the armature 8 is flattened in the area of the permanent magnets 11*a*, 11*b* and is cylindrical elsewhere.

Figure 6:
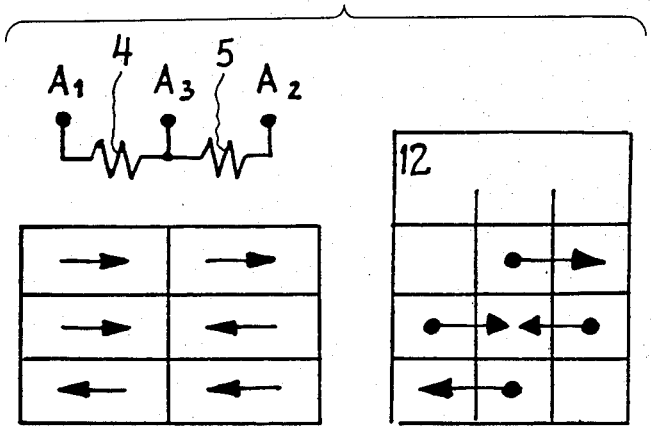
FIG. 6 is a diagram explaining the tristable operation.

The diagram of FIG. 6 diagrammatically illustrates coils 4 and 5 connected in series and having terminals A1, A2 and A3. On the left, beneath the diagrammatically illustrated coils are shown in tabular form the possible directions of current flow through the coils and to the right thereof are illustrated the resulting movements of the armature and, the consequent reverse motion of the adjusting slide 12. The coils 4 and 5 are assumed to be wound in the same sense. The end of the coil 4 and the start of the coil 5 are connected together by way of the common terminal A3. As shown in the drawing, an equidirectional current flow through both coils produces motion in one or the other direction of the armature from its central position to one or the other end positions. As a result of the current flow in opposite directions through coils 4 and 5, the armature drops out from either end position to the central position. However, if necessary, the central position can be bypassed by providing an equidirectional current flow through both coils opposite to that initially provided so that the armature can be switched from one end position directly to the other end position.

The flux paths 110*a* and 110*b* enable the permanent magnet 11 to hold the armature in one or the other end position after termination of the equidirectional current flow which produce the armature motion to that position, even against the compression force of the helical spring 18*a* or 18*b*. The opposed current flow through the two coils releases the armature from its end positions and allows it to be returned to the central position by the compression spring. Thus, the permanent magnet and the compression springs cooperate to provide switchgear with three stable positions. An important field of application for this type of switchgear, wherein the stable positions are retained even after elimination of the excitation that produced them, is the control of electric drives with reversible senses of rotation for which two mono- or bistable "reversal protections" were required in the past.

Additionally, through techniques known in the prior art, switching characteristics can be achieved wherein either only the central position and one end position, or the central position alone, is stable. In these cases, the armature returns to the central position either from one end position or from both end position as soon as the controlling current pulse has decayed.

Figure 7:
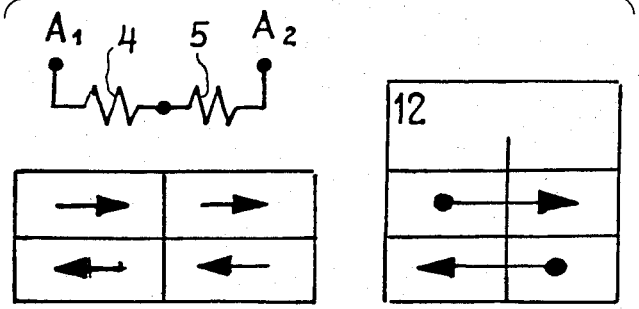
FIG. 7 is a diagram explaining the bistable operation.

FIG. 7 shows how the device of the present invention can be used as a bistable device, without modification. Thus, during bistable operation the terminal A3 is not needed, and unidirectional current flow is provided in either one direction or the other so that the armature can be switched from one end position directly to the other end position. Instead of bistable switching characters, one can, in addition, obtain mono-stable switching characteristics through techniques known in the prior art, whereby one of the coils can be used as a holding winding for the nonstable end position.

Figure 8:
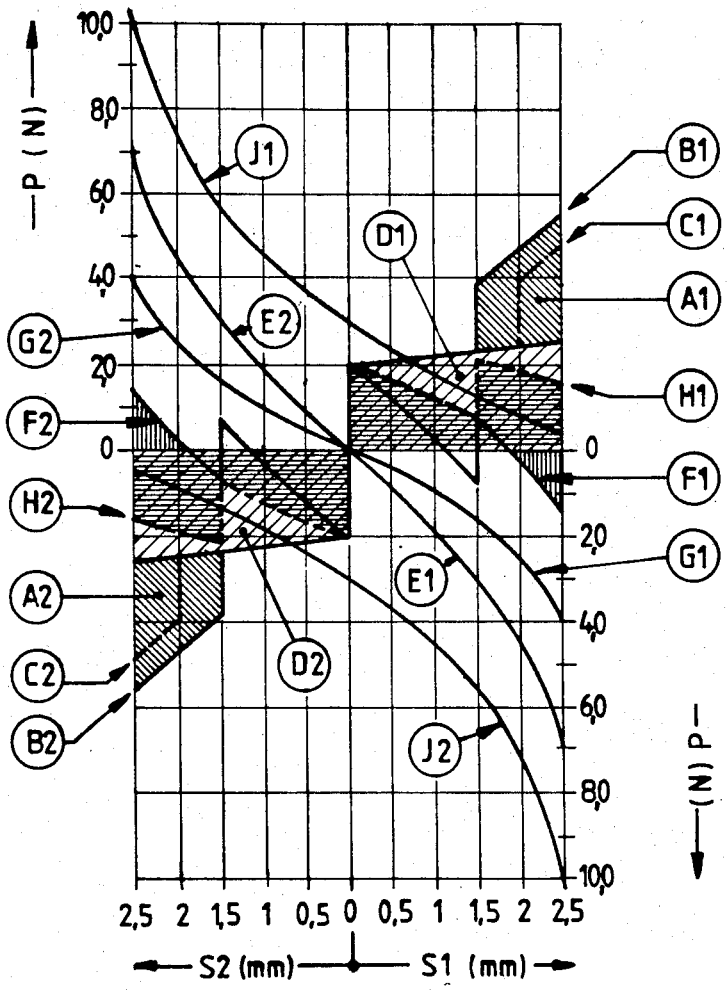
FIG. 8 is a diagram explaining the force/path relationship of the switchgear.

FIG. 8 shows a force/path diagram of the switchgear described hereinabove with one, two or three stable positions.

There have been plotted on the abscissa, starting out from the central position: path S1 of the adjusting slide 12 into the right end position, and the path S2 into the left end position. The force has been plotted on the ordinate.

The hatched surfaces:

A1/A2 represent the force contents of the conventional compression springs (not shown), whereby the boundaries of the novel contacts are formed by the lines:

B1/B2 or by the lines:

C1/C2 in the case of burned-out contacts.

The following has been taken as a basis:

Flexing of the novel contacts: 1 mm

Permissible burn-out: 0.5 mm

Remaining dimension of burned-out contacts: 0.5 mm

Initial contact forces: 3·50 cN=150 cN

Contact forces in the end position: 3·100 cN=300 cN in burned-out contacts: 3·75 cN=225 cN.

D1/D2 I is the force contents of the return springs 18*a*, 18*b*.

E1/E2 is the force of attraction of the permanent magnets, wherein:

- E1 represents the armature movement from the central position to the right;
- E2 represents the armature (8) movement from the central position to the left.

The adhesive force of the permanent magnet 11 is 700 cN.

F1/F2 is the difference between E1/E2 and the summation curve of B1/B2+D1/D2. The excess force of the permanent magnet 11 in and before the end position (hatched vertically in the diagram) leads to the stable end position of the armature and, thus, of the adjusting slide 12. An automatic resetting of one or of both end positions to the central position can be achieved, for example, by means of a spacer plate (anti-stick plate) secured to one or to both end faces of the armature 8.

Through current flow in opposite directions through the coils 4 and 5 and in order to drop the armature from a stable end position to the central position, the force of attraction E1/E2 of the permanent magnet 11 is reduced in accordance with the intensity of the exciting current, resulting, for example, in the curve:

G1/G2 —Reduction to approximately zero or until the algebraic sign changes is possible. A resultant force vector results upon reducing the permanent-magnet force to G1/G2.

H1/H2 with the corresponding horizontally hatched force contents. The armature is dropped to the stable central position.

However, the central position can be eliminated if both coils are excited equidirectionally, so that the magnetic force curve is shifted to:

J1/J2 and the following acceleration forces result: The sum of the magnetic-force curve J1 plus the spring forces of the springs 18*a*, 18*b* (surface D1) and the contact compression springs (surface A1) acts up to the central position. The difference between the curve J1 and the opposing spring forces (surface D2/A2) acts from the central position. J1=1,050 cN−550 cN (spring forces)=500 cN acts as a holding force in the left end position. In the case of a permanent-magnet force E2 of 700 cN the excitation of both coils can be switched off. The switchgear holds its own (stable end position). However, if the permanent-magnet force E1 is smaller than the spring pressure forces of the return spring 18*a* or 18*b* and of the contact springs, the switchgear drops back to the central position after switching off the coil excitation and will behave as a conventional electromagnetic protection. If both coils 4 and 5 are excited equidirectionally, there results, starting out from the central position, an initial excess of force for the accelerations of 100 cN, viz. 300 cN less the force of the return springs of 200 cN.

Figure 9:
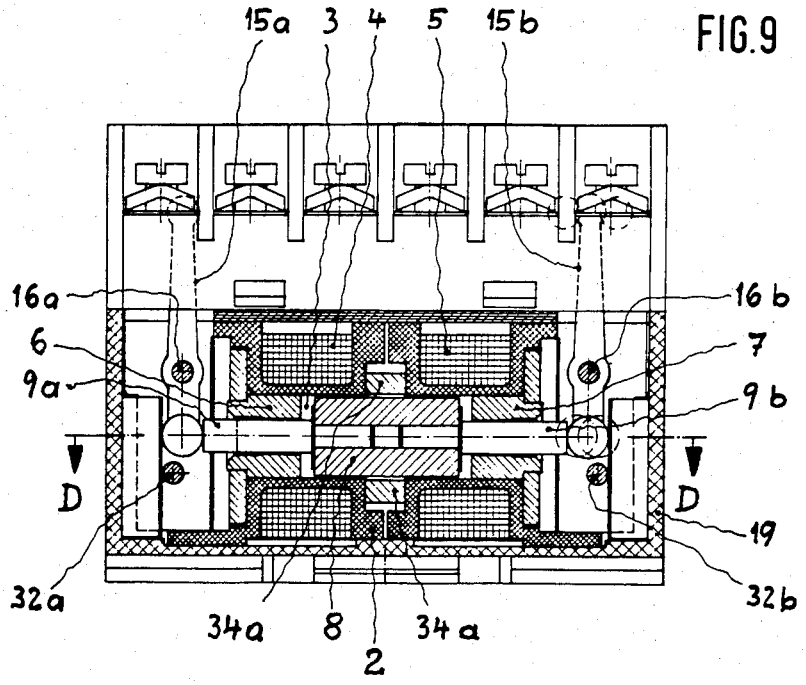
FIG. 9 is a cross-sectional side view of a modified form of the switchgear.
Figure 10:
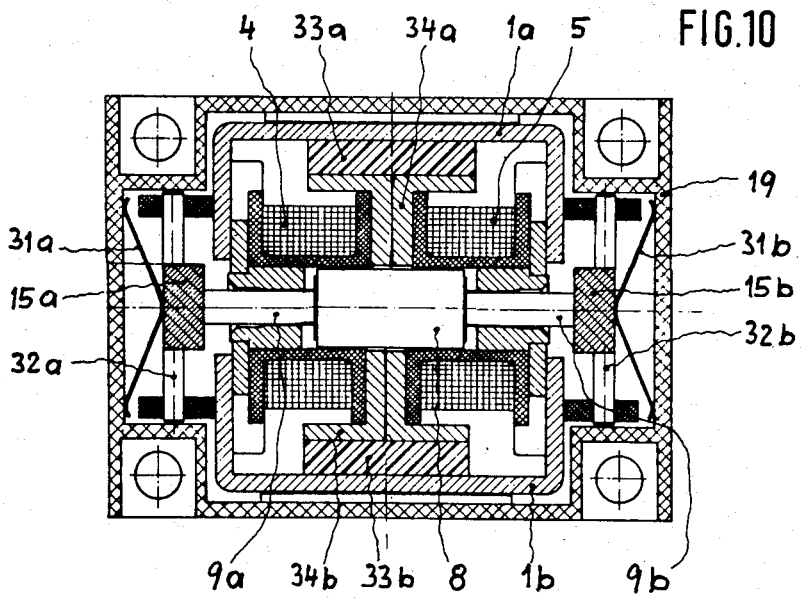
FIG. 10 is a cross-sectional view taken along the line d—d in FIG. 9.

FIGS. 9 and 10 illustrate another specific embodiment of the switchgear of the present invention. The magnetic drive is composed of two yoke halves 1*a* , 1*b*, as in previous embodiments. The yoke halves surround a coil form 2 having a continuous bore 3 and being divided into two chambers, each of which contains its own coil winding 4 and 5, respectively. The yoke halves 1*a* and 1*b* reach from both ends of the coil form into the bore 3 by means of core pieces 6 and 7, as previously described. The inner end faces of the core pieces form the pole faces which cooperate with the corresponding ends of an armature 8 constructed of a soft magnetic material. The armature is connected to a non-magnetic two-part guide bar 9*a*, 9*b*. The outer ends of each guide bar 9*a* and 9*b* are operably connected to one end of a corresponding two-arm reverse-transfer lever 15*a* and 15*b*, respectively, the levers being pivotally mounted on corresponding fulcrums 16*a* and 16*b* and being secured at their other ends in an adjusting slider.

Compared with the specific embodiments described above and shown, for example in FIG. 2, where only one reverse-transfer lever is connected between the adjusting slider and a fork connected to one end of the guide bar of the armature, the present specific embodiment has the advantage that the two reverse-transfer levers are subjected to pressure only so that the fork and the connecting point between it and the guide bar can both be eliminated.

Moreover, in this specific embodiment, the resetting force is no longer produced by helical compression springs acting on the adjusting slider, but by two preloaded return springs 31*a* and 31*b* acting directly on the guide bars 9*a*, 9*b*. These return springs, best illustrated in FIG. 10, are designed as leaf springs with their free ends bearing against the housing 19 of the switchgear, while in the rest position the apex of each spring bears against a corresponding stop such as bolts 32*a* and 32*b*, respectively, in order to achieve the desired preloading to obtain centering of the armature. Compared with the mounting of the return springs in the contact apparatus, as was the case with previous embodiments, the arrangement of FIGS. 9 and 10 results in advantages for the mounting and for possible adjustment.

In the embodiment shown in FIGS. 9 and 10, the permanent magnet flux is generated by means of two rectangular parallelepipedal permanent magnets 33*a* and 33*b* arranged centrosymmetrically between the yokes 1*a* and 1*b* and the flux guiding pieces 34*a* and 34*b*. The latter pieces each extend with one leg between the two chambers of the coil form 2 to the vicinity of the armature 8.

Figure 11:
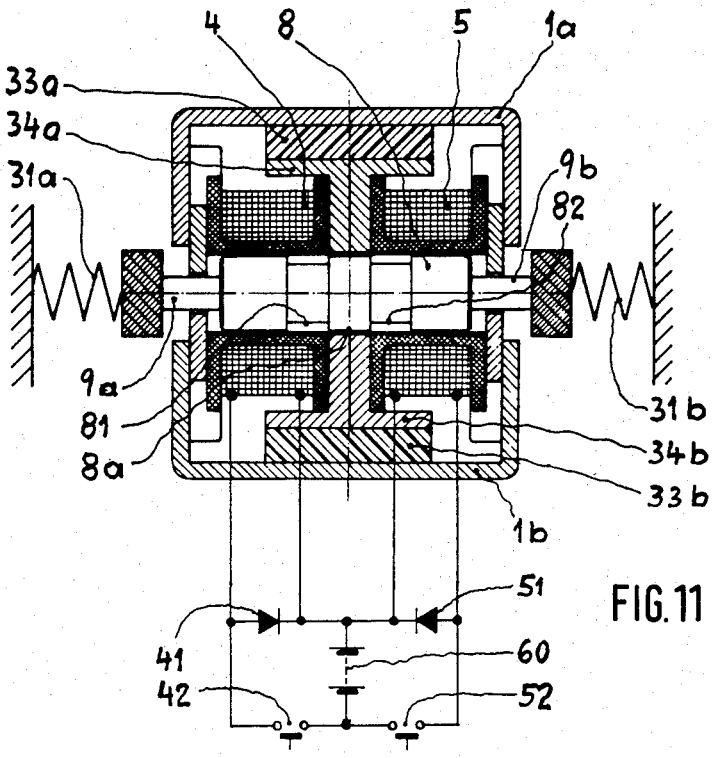
FIG. 11 is a cross-sectional of still another modification of the magnetic drive of the present invention.
Figure 12:
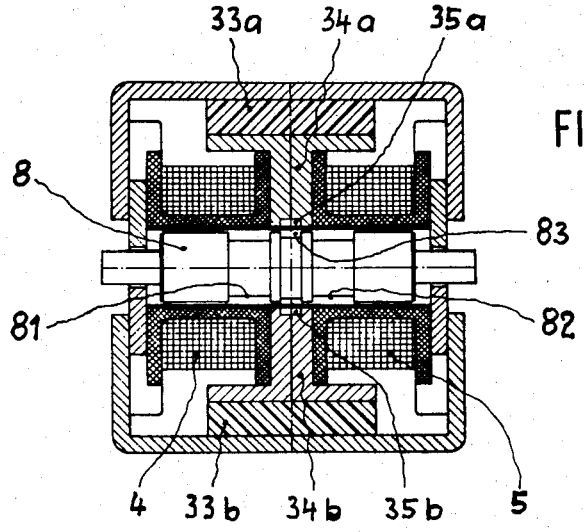
FIG. 12 is a cross-sectional view of another modification of the magnetic drive of the present invention.

FIGS. 11 and 12 show two specific embodiments of the switchgear in which the permanent magnets 33*a* and 33*b* and the flux guiding pieces 34*a* and 34*b* are arranged in the manner shown in FIGS. 9 and 10, but additional steps have been taken to stabilize the armature in the central position. One of these steps consists in designing the surfaces of the armature 8 and the opposite surfaces of the flux guiding pieces 34*a* and 34*b* as pole faces which are symmetrical to each other. In the case of FIG. 11, the armature 8 has a stepped pole face 8*a* which is generated by two annular notches 81 and 82 which are symmetrical to each other.

As is apparent from FIG. 12, the resultant concentration of the magnetic flux flowing from the flux guiding pieces into the armature, and thus onto the central stepped section of the armature can be further increased by providing the central portion of the armature 8 with a ring groove 83. Similarly, the flux guiding pieces 34*a* and 34*b* are provided with recesses 35*a* and 35*b*, respectively, which are symmetrical to the ring groove 83 so that the pole faces, which lie opposite each other in a central position of the armature 8, become narrower and the magnetic flux thus becomes more heavily concentrated.

Another step for stabilizing the central position of the armature is shown in FIG. 11 and can be used as an alternative or in addition to the steps previously discussed. This step consists in wiring the windings 4 and 5 with three-running diodes 41 and 51, respectively, connecting the end of the winding 4 with the start of the winding 5, and connecting one of the terminals of a supply voltage source 60 to this junction between windings 4 and 5. The other terminal of the supply source is connected by means of keying switches 42 and 52 to the start of winding 4 or the end of winding 5, respectively. With this arrangement, when the armature 8 is dropped from one of its two possible end positions to the central position, any reverse polarity voltage induced into the coils is short-circuited by the diodes 41 or 51 so that the velocity with which the armature 8 returns to its central position is reduced and, as a result, the risk of overshooting the central position is lessened.

Although the present invention has been described in terms of preferred embodiments thereof, it will be understood that the true spirit and scope of the invention is limited only by the following claims.

What is claimed is:

1. Electromagnetic switchgear comprising a magnetic drive having a yoke which contains a permanent magnet arrangement and surrounds a coil form whose continuous bore contains an armature which, by means of a reverse-transfer lever, actuates an adjusting slider mounted with allowance for sliding in a contact apparatus placed above the coil form parallel to the longitudinal axis thereof, the adjusting slider being in operative connection with two return springs preloaded in opposite directions, and carrying spring-loaded bridge contacts to each of which are assigned two opposed fixed contacts, characterized in that said coil form is subdivided into two spaced-apart chambers arranged side by side which receive corresponding coil windings, that said permanent magnet arrangement lies symmetrically to the longitudinal axis of said coil form between said two chambers, is polarized at right angles to the longitudinal axis of the coil former, and has a through-opening for said armature which corresponds substantially to the diameter of the bore of the coil form, said armature being mounted on a non-magnetic guide bar and having two end faces which cooperate with the pole faces of the yoke located in the area of the end openings of the bore of the coil form, and that the adjusting slider is in operative connection with both return springs only in its geometric middle position, but upon leaving said middle position stresses only one of the return springs.

2. The switchgear as defined in claim 1, characterized in that said yoke incorporates two core pieces located within the coil form and which are constructed as bearing points for said armature guide bar in the area of said pole faces turned toward said armature.

3. The switchgear as defined in claim 1, characterized in that the permanent magnet arrangement consists of a disk-shaped permanent magnet.

4. The switchgear as defined in claim 1, characterized in that the permanent magnet arrangement consists of two opposed permanent magnets having the shape of a rectangular solid, wherein the permanent magnet poles which are turned toward each other are like poles, and that the armature is cylindrical, but is parallelepipedal in the area of the permanent magnet poles.

5. The switchgear as defined in claim 1, characterized in that the yoke consists of two flat-profile yoke halves which lie opposite each other relative to the longitudinal axis of the coil form.

6. The switchgear as defined in claim 1, characterized in that the return springs consist of two preloaded helical compression springs lying coaxially in a recess of the housing of the contact apparatus, between those ends turned to each other there is placed a driving key of said adjusting slider, which key, when the adjusting slider moves from its middle position, stresses only one of the return springs, while the other return spring is supported against housing projections.

7. The switchgear as defined in claim 1, characterized in that said reverse-transfer lever is hinged to the end of said armature guide bar and is mounted on a pivot in the manner of a double-arm lever.

8. The switchgear as defined in claim 1, characterized in that the return springs consist of two preloaded leaf springs, each of which cooperates with one end of said armature guide bar, is supported with its two ends against the housing of the switchgear, and bears with its vertex in the middle position of the armature against a stop.

9. The switchgear as defined in claim 1, characterized in that there is provided two reverse-transfer levers, each of which is mounted on a corresponding pivot, and one end of which is in operative connection with one end of the armature guide bar, and its other end with the adjusting slider.

10. The switchgear as defined in claim 1, characterized in that the permanent magnet arrangement consists of two permanent magnets having the shape of a rectangular solid and lying symmetrically opposite each other relative to the armature, each of which bears with one pole face against said yoke and with its other pole face against a flux-guiding piece which extends between said two chambers of said coil form and reaches to the vicinity of said armature.

11. The switchgear as defined in claim 10, characterized in that the opposed areas of said flux-guiding pieces and of said armature are designed as pole faces which are symmetrical to each other.

12. The switchgear as defined in claim 1, characterized in that a free-running diode is connected in parallel to each of said coil windings, that the end of the winding of one coil winding is connected at a junction with the start of the winding of the other coil winding, that one terminal of a current source is connected to said junction, and that the other terminal of said current source is connected to the start of the winding of one coil winding via a first switch, and with the end of the winding of the other coil winding via a second switch.

* * * * *